United States Patent [19]

Ramos et al.

[11] Patent Number: 4,870,784

[45] Date of Patent: Oct. 3, 1989

[54] LENS EDGING MACHINE AND METHOD

[75] Inventors: Rolando P. Ramos, Des Plaines; Wilfredo P. Loreto, Hoffman Estates; Yordan Vulich, Oak Lawn, all of Ill.

[73] Assignee: AIT Industries, Inc., Schaumburg, Ill.

[21] Appl. No.: 294,236

[22] Filed: Jan. 9, 1989

Related U.S. Application Data

[62] Division of Ser. No. 551,148, Nov. 14, 1983, Pat. No. 4,807,398.

[51] Int. Cl.[4] ..... B24B 9/14

[52] U.S. Cl. ..... 51/165 R; 51/97 NC; 51/105 EC; 51/284 E; 51/101 LG

[58] Field of Search ..... 51/97 NC, 101 LG, 105 EC, 51/106 LG, 165 R, 165.71, 284 E; 409/97, 104, 110, 111, 112, 113

[56] References Cited

U.S. PATENT DOCUMENTS

| | | | |
|---|---|---|---|
| 3,673,738 | 7/1972 | Stern | 51/106 LG X |
| 3,894,361 | 7/1975 | Georgiadis et al. | 51/101 LG |
| 4,203,259 | 5/1980 | Haddock | 51/106 LG X |
| 4,383,393 | 5/1983 | Takubo | 51/101 LG |
| 4,394,099 | 7/1983 | Santinelli | 51/101 LG X |
| 4,512,108 | 4/1985 | Kobayashi | 51/101 LG |

*Primary Examiner*—Robert P. Olszewski

*Attorney, Agent, or Firm*—Juettner Pyle Lloyd & Verbeck

[57] ABSTRACT

A machine for grinding the peripheries of ophthalmic lenses to predetermined outlines is characterized by a head having a rotatable workholder for moving an edge of a lens against a rough grinding or finishing wheel and a pattern holder positioned vertically above the workholder for controlling movement of the lens toward and away from the grinding wheel. The head is mountd for horizontal, vertical and pivotal movement, is allowed to freely pivot during finishing or bevel edging of a lens but not during rough grinding, and is automatically locked against pivotal movement upon completion of bevel edging so that the lens may, if required, be returned to the same position against the finishing wheel. Circuitry controls movement of the head in accordance with the base curve of a lens to precisely position the lens with respect to the finsihing wheel, and maintains the machine in each of its rough grinding and finishing stages for a period of time which is sufficient to complete the grinding operation and independent of the number of rotations of the workholder.

11 Claims, 6 Drawing Sheets

42
176
180
184
186
182
178
130
128
60
3
46
134
76
156
85
86
90
74
76a
122
176
120
124
88
92
3
160
162
158
48
54
160
96
132
104
112
108
110
106
150
154
114
118
152
140
116
102
142
70
132

42
164
4
178
186
184
180
182
130
128
168
166
76a
98
94
85
86
90
76c
74
76d
88
46
122
76
120
92
76b
198
100
190
134
188
136
78
96
148
132
138
146
116
54
118
144
140
142
4

5.

186
184
182
130
128
160
94
82
34
56
60
58
85
78
64
80
74
76
68
62
84
46
190
188
158
92
88
66
96
136
38
160
132
54
40
5.
142

42
172
174
164
184
178
180
176
128
130
182
186
168
187
170
166
54
34
32
64
185
36
52
46
62
48
50
66
22
28
24
54
70
38
72
40

LENS EDGING MACHINE AND METHOD

This is a divisional of co-pending application Ser. No. 06/551,148 filed on Nov. 14, 1983 now U.S. Pat. No. 4,807,398.

BACKGROUND OF THE INVENTION

The present invention relates to machines for grinding articles, and in particular to a machine for grinding the edges of ophthalmic lenses to predetermined outlines.

In manufacturing ophthalmic lenses for eyeglass frames, a lens blank is first surface ground and polished to a predetermined prescription. The resulting lens has a circular periphery or edge, and is of a sufficient diameter that it may be ground to an outline corresponding to that of an eyeglass frame in which it is to be mounted and provided with a bevel for mounting in the frame.

Machines for grinding the peripheries of lenses to predetermined outlines and for forming bevels on the peripheries are referred to as bevel edging machines or bevel edgers. Such machines conventionally include a rotatable workholder for supporting and rotating a lens and for bringing the periphery of the rotating lens against either a rough grinding wheel or a finishing or beveling wheel having a V-shaped groove in its surface for grinding a bevel on the lens periphery. A pattern having an outline corresponding to that to which the lens is to be ground is carried on an end of the workholder, and controls movement of the workholder toward and away from the rough grinding and beveling wheels to cause the periphery of the lens to be ground to the configuration of the pattern. During rough grinding, the pattern is held above a first clapper switch or roughing wear plate until the lens periphery has been ground by an amount permitting the pattern to move against and actuate the switch, whereupon the workholder is rotated to bring new unground portions of the lens periphery into engagement with the grinding wheel, which moves the pattern away from the switch to stop rotation of the workholder until a sufficient amount of the new portion of the periphery has been ground away, whereupon the cycle is repeated. The peripheral portions of the lens are thus sequentially engaged with the grinding wheel to rough grind the lens edge to a configuration corresponding to that of the pattern, and in the usual roughing cycle rough grinding of the lens is limited to two complete revolutions of the workholder, after which it is assumed that the lens has the selected configuration.

To form a bevel on the lens edge, after rough grinding the lens is positioned opposite from the finishing wheel and the pattern above a second clapper switch or finishing wear plate, which switch also controls rotation of the workholder in accordance with engagement of the pattern therewith. The beveling cycle then proceeds in a manner similar to that of the roughing cycle, with the lens being moved toward and away from the bevel edging wheel by engagement of the pattern with the second switch and with the switch controlling rotation of the workholder upon the pattern moving against it. As for the roughing cycle, the bevel edging cycle is usually limited to two complete revolutions of the workholder.

For a more complete description of a known type of bevel edging machine, attention is invited to Stern U.S. Pat. No. 3,332,172, issued July 25, 1967 and assigned to the assignee of the present invention, the teachings of which are incorporated herein by reference.

Although relatively thin lense of small minus powers may often be rough ground and bevel edged to the proper size within two rotations of the lens during each grinding cycle, it often happens that thicker lenses of larger minus powers require more than two revolutions during one or both cycles to be fully ground to the selected configuration, which is not accommodated by the two rotation limit of conventional bevel edgers. This gives rise to a further disadvantage since if the lens periphery is not fully ground during the revolution limited grinding cycles, that circumstance is usually not ascertained until after the lens has been removed from the machine and an attempt is made to fit it into an eyeglass frame. If further grinding of the lens is required, it is then difficult to properly align the bevel already formed on the lens with the V-shaped groove in the finishing wheel so that another finishing cycle can be performed, which can result in an imperfect bevel and fit of the lens in the eyeglass frame. Also, most conventional bevel edgers do not readily accommodate automatic formation of bevels toward the front faces of lenses having different base curves, but instead require visual observation and manual effort by an operator to form the bevel at that position so that the lens will have a cosmetically acceptable appearance in the frame.

Another disadvantage of conventional bevel edgers is that the workholder is elongate an supported for rotation by a carriage, the pattern is at an end of the workholder and the carriage gravity urges the lens against the grinding wheels and the pattern against the clapper switches. In consequence, as the lens is ground the pattern supports the weight of the carriage and a bending moment of force is exerted on the workholder, which deforms the workholder and causes an inaccuracy between movement of the lens and the pattern. As a result, the lens periphery is often not ground to a configuration precisely corresponding to that of the pattern.

OBJECTS OF THE INVENTION

An object of the present invention is to provide an improved bevel edging machine for very accurately grinding the peripheries of ophthalmic lenses to predetermined outlines or configurations.

Another object is to provide such a machine in which the rough grinding and bevel edging cycles are continued until the lens periphery has been fully ground to the selected configuration.

A further object is to provide such a machine in which a workholder for a lens and a pattern for controlling movement of the workholder and lens toward and away from grinding wheels are vertically aligned and interconnected, such that there is no deformation of the workholder by the pattern and movement of the lens very accurately follows that of the pattern.

Yet another object is to provide such a machine in which the grinding wheels are angulated with respect to the lens and the workholder is rendered free to pivot during finish grinding of a bevel on the lens.

A still further object is to provide such a machine in which the workholder is locked against pivotal movement upon completion of finish grinding, so that if necessary the lens may be accurately returned to the same position against the finishing wheel.

A yet further object is to provide such a machine which has circuitry for compensating for various base curves of lenses to be ground, so that bevels are formed on the peripheries of the lenses toward their front faces.

SUMMARY OF THE INVENTION

In accordance with the present invention, there is provided an improved bevel edging machine for grinding the peripheries of ophthalmic lenses to outlines corresponding to those of patterns and for grinding bevels on the peripheries to accommodate mounting of the lenses in eyeglass frames. In accordance with one aspect of the invention, to ensure that the lenses are fully ground, the grinding operations are continued until there occurs an uninterrupted rotation of the lens against each grinding wheel for at least one complete revolution, or until the pattern actuates a clapper switch without interruption for at least a selected time, as compared with the conventional practice of rotating the lens through a fixed number of revolutions.

According to a further feature of the invention, compensation is made for the base curve of a lens, so that a bevel ground on the lens periphery will be toward the front face of the lens. To that end, prior to bevel edging the lens with a finishing wheel, the lens is translated a selected distance from a reference position to an operative position opposite from a bevel forming groove in the wheel, the distance being selected so that the lens is oriented to have the bevel ground on its periphery toward its front face. Preferably, the lens is translated at a constant rate from the reference to the operative position, and the distance the lens is translated is determined by controlling the time of translation to be in accordance with the base curve of the lens.

A microprocessor circuit controls operation of both of the above features of the machine, as well as the overall operation of the machine in performing various functions.

The bevel edging machine also includes an improved structure, so that during grinding of a lens the lens, grinding wheel, pattern and clapper switch are all in substantial vertical alignment. The particular structure minimizes bending moments of force on a workholder for the lens, so that the resulting outline of the lens periphery very closely corresponds to that of the pattern.

In addition to a vertical alignment of structure, a further improvement is that a head for carrying and guiding the workholder, clapper switch and pattern is mounted for horizontal movement to move the lens between rough grinding and finishing wheels, vertical movement to bring the lens against and to then move the lens toward and away from the wheels in accordance with a corresponding movement of the pattern toward and away from the clapper switch, and pivotal movement to allow the lens to pivot to a proper orientation with respect to the finishing wheel groove during grinding of a bevel on the lens. The head is carried on a horizontally movable float, a vertically movable carriage, a vertically movable frame and a fixed frame which mounts the grinding wheels, and except during the bevel edging operation, is locked against pivotal movement. The head is also automatically locked against pivotal movement at the end of the bevel edging operation, so that if further bevel edging is required, the head and workholder are properly oriented with respect to the finishing wheel and the lens may again be bevel edged without accidental grinding away of the previously formed bevel.

The foregoing and other objects, advantages and features of the invention will become apparent upon a consideration of the following detailed description, when taken in conjunction with the accompanying drawings.

DETAILED DESCRIPTION

Figure 1:
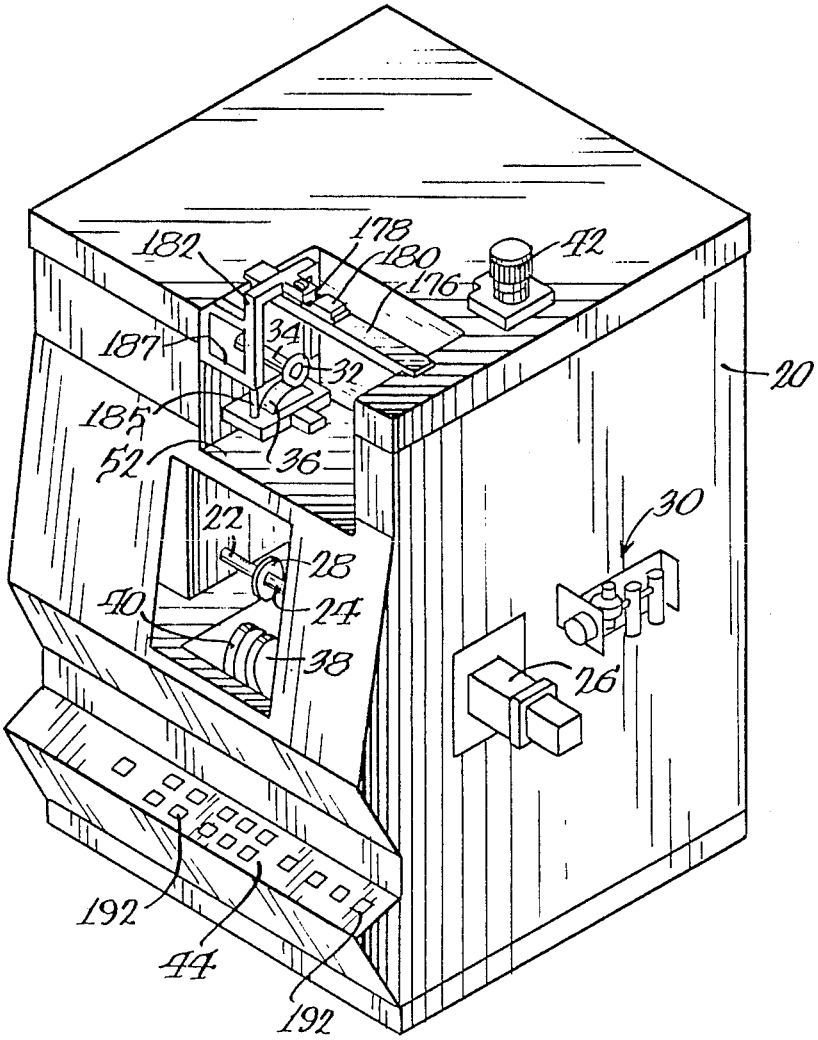
FIG. 1 is a perspective view of a bevel edging machine for grinding the peripheries of ophthalmic lenses to predetermined outlines or configurations, illustrating the machine in its outer cabinet.

In FIG. 1 a bevel edging machine according to the present invention is shown within its outer cabinet 20. The machine is for grinding the peripheries of ophthalmic lenses to predetermined outlines or configurations, first by rough grinding a lens periphery to a selected configuration and then by grinding a V-shaped bevel on and around the periphery. The shape or configuration of the resulting periphery corresponds to that of an eyeglass frame in which the lens is to be placed and the bevel accommodates mounting the lens in the frame. The bevel is ideally formed on the lens periphery toward the front face of the lens, so that when the lens is mounted in an eyeglass frame, the major portion of its peripheral surface extends inwardly of the frame for enhanced cosmetic appearance.

The bevel edger includes a rotatable lens chuck or workholder having opposed arms 22 and 24, and an inner end of the arm 24 is movable toward and away from an inner end of the arm 22 by a pneumatic cylinder 26 to grip a blocked ophthalmic lens 28 therebetween. A regulator 30 controls the pressure of air supplied to the cylinder, and a pattern 32 carried by a pattern holder 34 is rotatable against a wear plate or clapper switch 36 to control movement of the workholder, and therefore of the periphery of the rotating lens, toward and away from grinding surfaces of a roughing wheel 38 and a finishing or beveling wheel 40 to grind the lens periphery to a configuration corresponding to that of the pattern. An eye size compound assembly 42 is adjustable to control the overall dimensions to which the lens periphery is ground, and a control panel 44 has a plurality of switches for controlling operation of the bevel edger.

Figure 3:
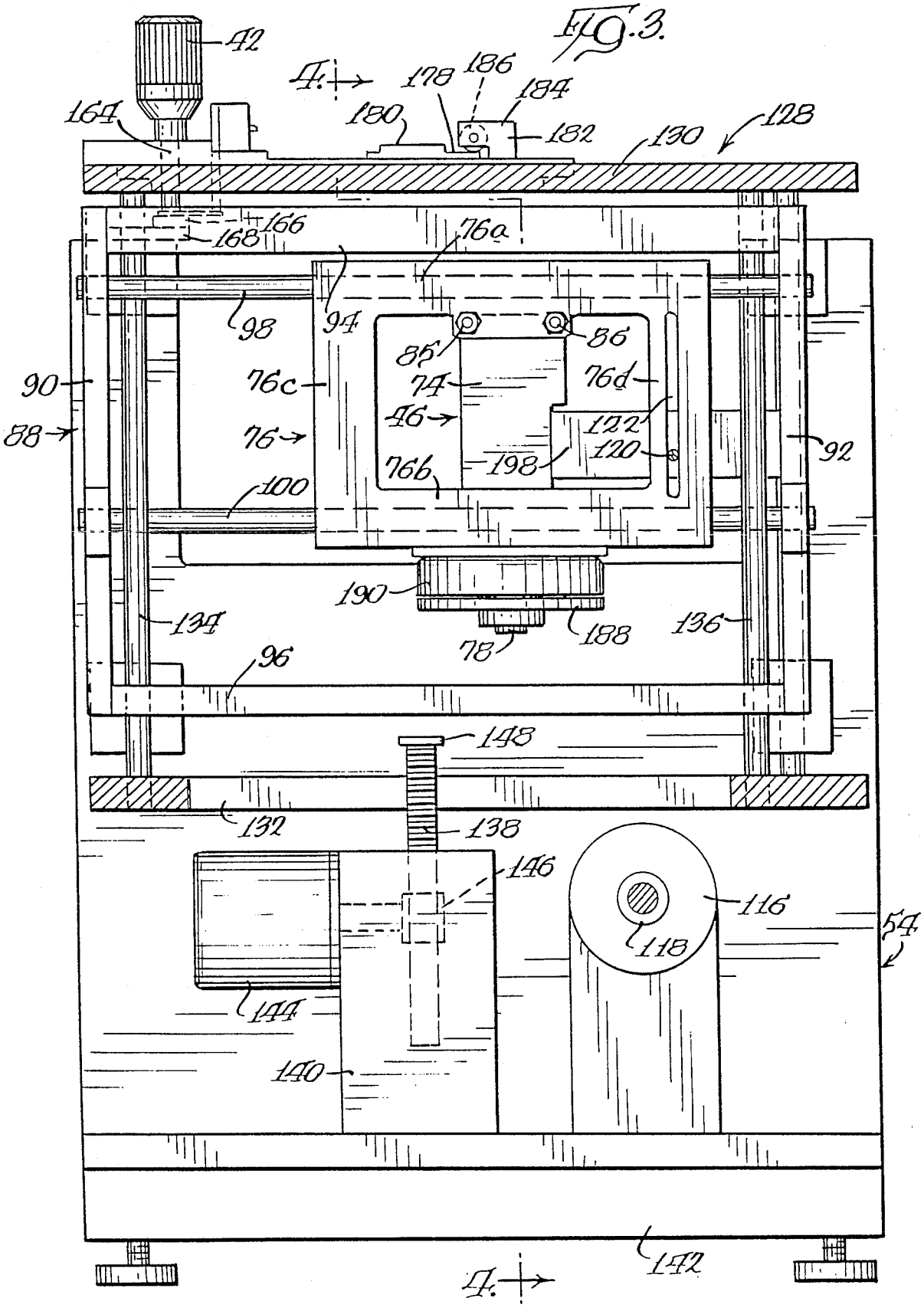
FIG. 3 is a cross sectional back elevation view of the machine taken substantially along the lines 3—3 of FIG. 2.
Figure 4:
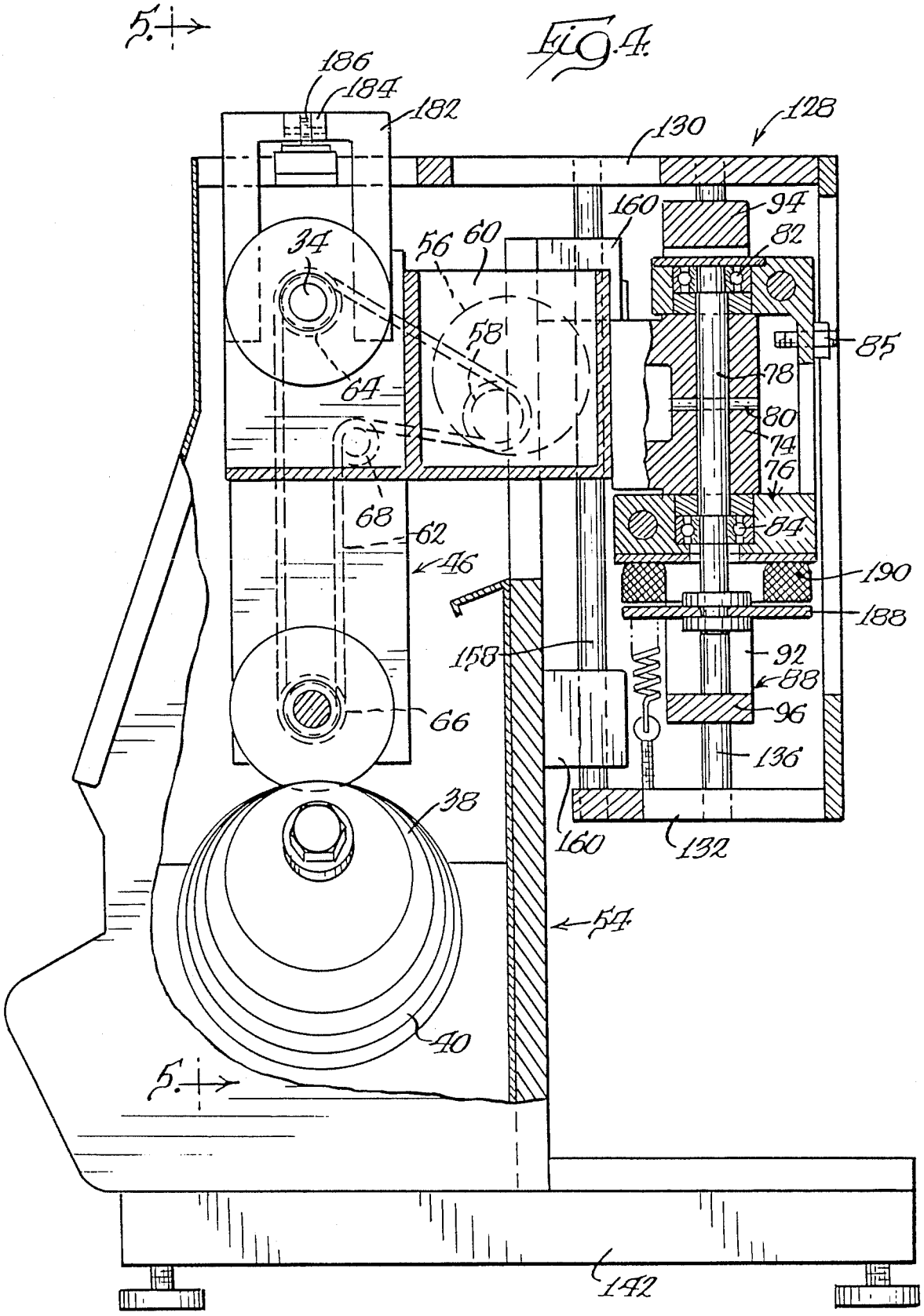
FIG. 4 is a cross sectional side elevation view of the machine taken substantially along the lines 4—4 of FIG. 3.
Figure 5:
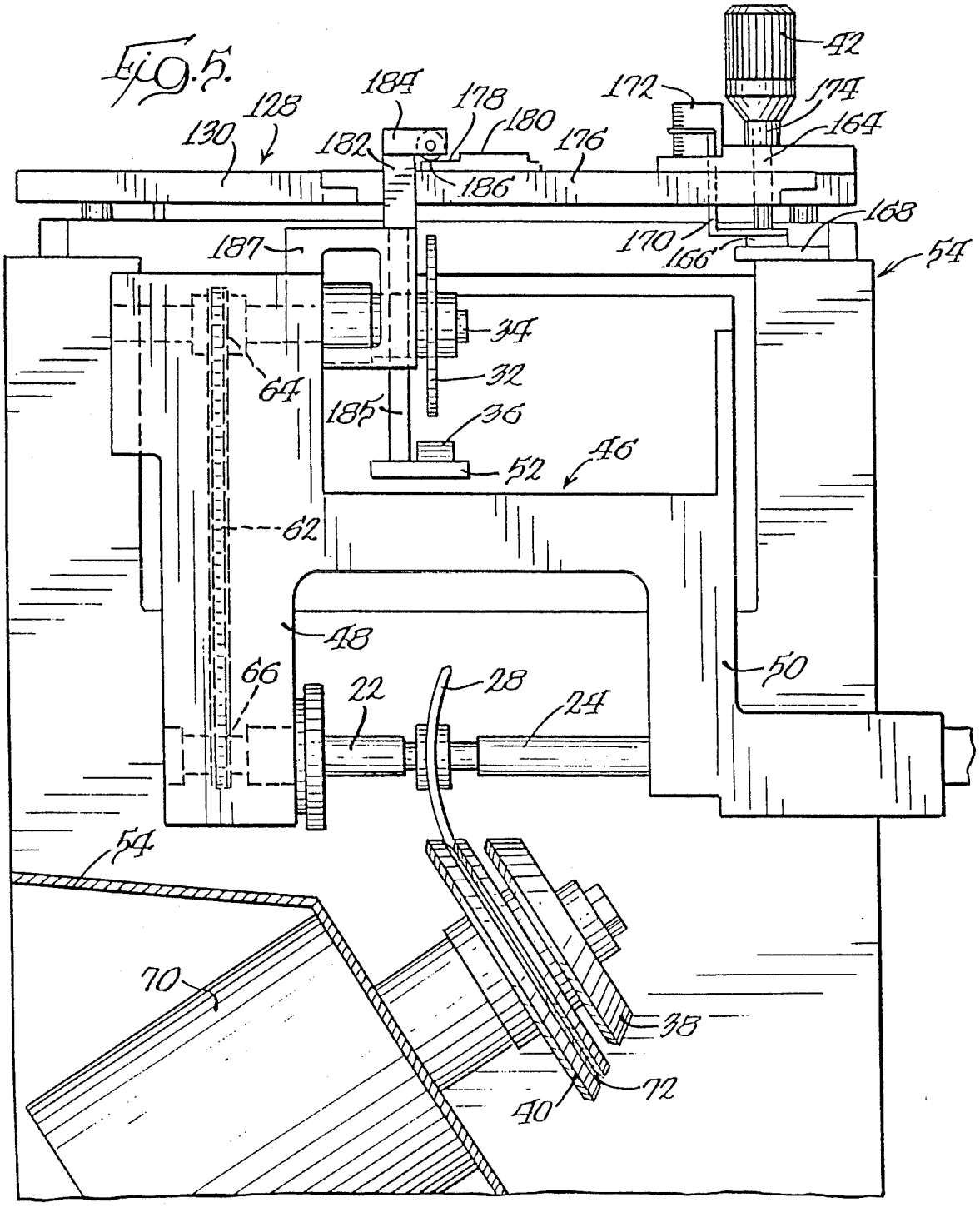
FIG. 5 is a cross sectional front elevation view of the machine taken substantially along the lines 5—5 of FIG. 4.
Figure 6:
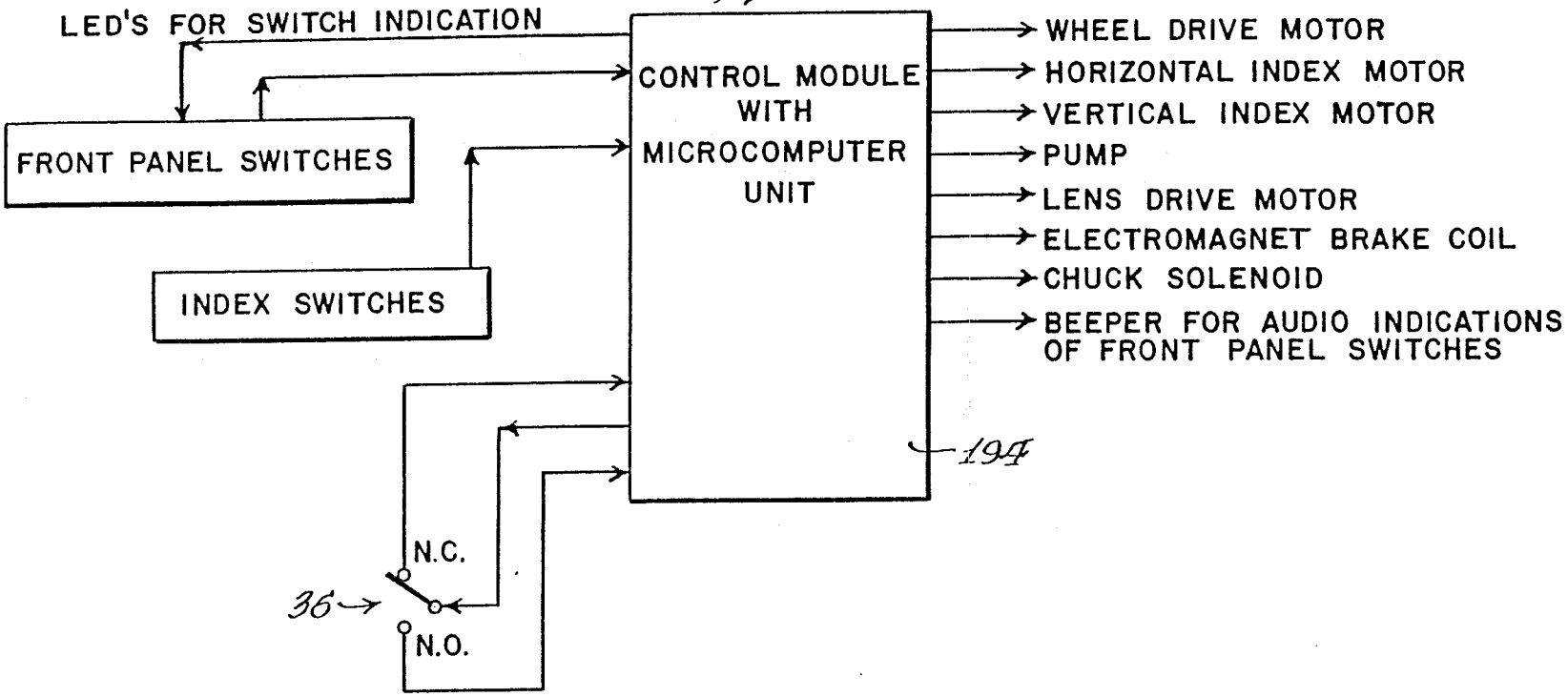
FIGS. 6 and 7 illustrate in block diagram form circuits for controlling operation of the machine.

Considering the structure of the bevel edger in greater detail, with reference also to FIGS. 2–5 the machine includes a head, indicated generally at 46, the forward end of which has a pair of downwardly depending members 48 and 50 in which the lens chuck arms 22 and 24 are journaled for rotation. The pattern holder 34 is journaled for rotation in an upper end of the member 48 to rotate the pattern 32 against the clapper switch 36 which is carried on a platform 52 (FIG. 5). To rotate the pattern and lens chuck in unison, a lens drive motor 56 having an output sprocket 58 is in a compartment 60 in the head, and a timing chain 62 extends around the output sprocket 58, a sprocket 64 on the pattern holder 34, a sprocket 66 on the arm 22 of the lens chuck and an idler sprocket 68.

The rotating lens chuck carries the periphery of the lens 28 against the grinding surfaces of the roughing wheel 38 and the finishing or beveling wheel 40, which are mounted for rotation in planes angulated with respect to vertical on an output shaft of a grinding wheel motor 70, and have grinding surfaces which extend in a horizontal plane at their upper ends. The grinding wheel motor is mounted on a fixed frame 54, and the finishing wheel has a V-shaped groove 72 formed in and around its grinding surface, such that introduction of the periphery of a rotating lens into the groove grinds a bevel on the periphery. As will subsequently be described in greater detail, when the periphery of the rotating lens is brought against the grinding surfaces of the rough grinding and finishing wheels, rotation of the pattern 32 across the surface of the clapper switch 36 raises and lowers the head to move the lens toward and away from the grinding wheels in a manner to grind the lens periphery to an outline complementary to that of the pattern.

The head 46 is adapted to be moved horizontally to carry the lens 28 between the rough grinding wheel 38 and the finishing wheel 40, to be moved vertically to carry the lens periphery against and away from the grinding surfaces and to freely pivot through a limited arc in a horizontal plane during grinding of a bevel on the lens periphery, whereby in combination with the angulation of the finishing wheel, placement of the bevel on the periphery is accurately controlled. To carry the head for horizontal, vertical and pivotal movement, a rectangular rearward end 74 of the head extends within an open center portion of a rectangular float, indicated generally at 76, having top, bottom and side members **76*a–d*. A shaft 78 extends through the rearward end of the head, is affixed thereto by a pin 80 and is journaled at its opposite ends in bearings 82 and 84 in the top and bottom float members 76*a* and 76*b*, whereby the head is pivotable on the float. To limit pivotal movement to within a selected range, a pair of stop pins 85 and 86 threaded through the top member 76*a*** are adjustable to extend toward the head to engage and limit the head to a selected range of movement.

To horizontally move the head, the float is mounted for horizontal movement on a carriage, indicated generally at 88. The carriage is a rectangular, open centered frame having two vertically extending said members 90 and 92, a top member 94 and a bottom member 96. A pair of horizontal shafts 98 and 100 extend through and are slidingly received within respective top and bottom members **76*a* and 76*b* of the float 76**, and are secured at opposite ends to respective side members of the carriage, whereby the float is horizontally movable along the shafts within the open center of the carriage.

Figure 2:
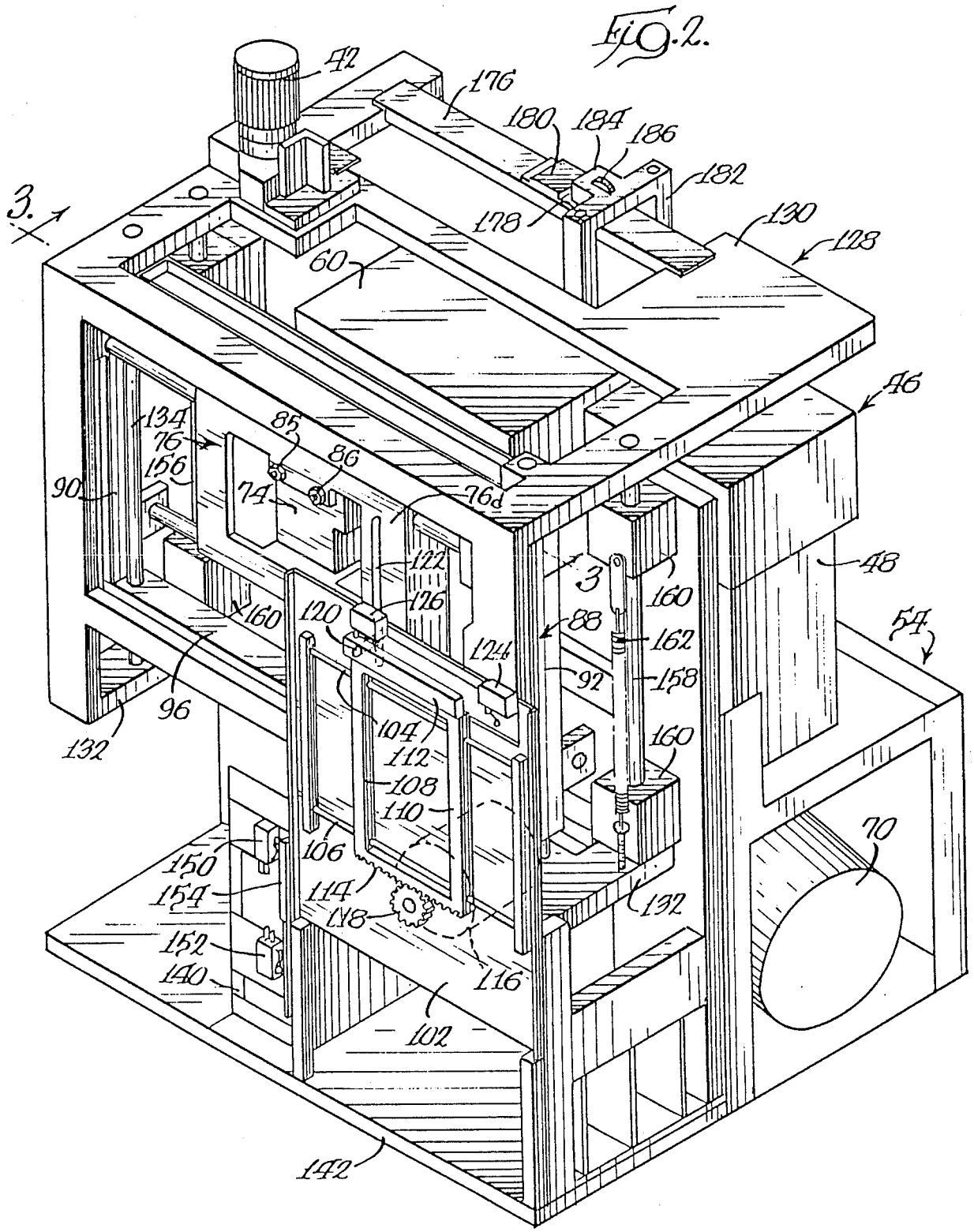
FIG. 2 is a perspective view of the back, top and left side of the machine as seen without its cabinet.

To drive the float 76 and head 46 left and right horizontally, as seen in FIG. 2 a plate 102 is on a back side of the fixed frame 54. A pair of vertically spaced shafts 104 an 106 extend horizontally across the back of the plate and are slidingly received within opposite sides 108 and 110 of a generally rectangular, open centered horizontal movement rack, which also has a top 112 and a toothed bottom 114 defining a rack. A left/right movement motor 116 carries on its output shaft a pinion 118 meshed with the rack, whereby the motor is energizable to drive the rack horizontally left and right. A pin 120 affixed to the top 112 of the horizontal movement rack extends through the open center portion of the plate 102 into a vertically extending slot 122 in the right side member **76*d* of the float, so that left/right movement of the horizontal movement rack imparts a corresponding movement to the float and hence to the head. Left and right movement limit switches 124 and 126 are engageable by the top 112** to limit horizontal movement of the rack.

To vertically move the head 46, the carriage 88 is mounted for vertical movement on a movable frame, indicated generally at 128, which includes a top 130 and a base portion 132. A pair of shafts 134 and 136 extend vertically between the top and the base of the movable frame in horizontally spaced relationship, and are slidingly received within the top and bottom members 94 and 96 of the carriage. Consequently the carriage, and with it the float 76 and head, are vertically movable.

To drive the carriage 88 in vertical directions, a rack 138 is mounted for vertical movement on a plate 140 carried by a base 142 of the fixed frame 54. An up/down movement motor 144 carries on its output shaft a pinion 146 meshed with the rack, whereby the motor may be energized to drive the rack in vertical directions. The upper end of the rack is not connected directly to the carriage, but has a pad 148 which engages the bottom member 96 of the carriage to raise and lower the carriage along the shafts 134 and 136, and the pad moves downwardly away from the carriage bottom with sufficient downward movement of the rack. Up and down limit switches 150 and 152 on the plate are engageable by a bar 154 connected with the rack to limit vertical movement of the rack, and therefore of the carriage, float and head.

The movable frame 128 is in turn mounted for vertical movement on the fixed or stationary frame 54 to enable the overall peripheral dimensions of a ground lens to be controlled in accordance with the setting of the eye-size compound assembly 42. The movable frame has a pair of shafts 156 and 158 at its opposite sides which extend vertically between its top 130 and the base portion 132. Each shaft is slidingly received within a respective pair of bearings 160 on the fixed frame, whereby the movable frame may be translated in vertical directions with respect to the fixed frame. A tension spring 162 at each end of the movable frame extends between the base portion 132 and a respective upper bearing 160 on the fixed frame to apply lift to the movable frame which, as will become apparent, relieves pressure on and facilitates adjustment of the eye-size compound assembly.

The eye-size compound assembly determines the minimum height of the movable frame 128 with respect to the fixed frame 54 to limit the maximum approach of a lens toward the grinding wheels. As best seen in FIGS. 3 and 5, the assembly is mounted on top of the movable frame and has a post 164 which extends downwardly and carries a foot 166 at its lower end for engaging and resting on a platform 168 on the fixed frame. Rotation of the upper end of the eye-compound assembly moves the post up and down, and thereby adjusts the minimum height the movable frame may have with respect to the fixed frame. To provide a visual reading of the setting of the eye-compound assembly, a pointer 170 connected to the post indicates the assembly setting on a coarse scale 172, while a fine scale 174 gives small dimension readings, the two taken together enabling an accurate visual reading of the eye-size compound assembly setting to be obtained.

As above stated, the setting of the eye-compound assembly 42 determines the minimum height the movable frame 128 may have with respect to the fixed frame 54 during a lens edging operation, and thereby the ultimate dimensions of the lens periphery. To that end, a support bar 176 extends across a cutout portion on the top 130 of the movable frame, and carries on its upper surface a stepped plate having a lower step 178 and an upper step 180. A generally U-shaped yoke 182 extends at its upper end over and around the support bar 176, and an extension 184 at the upper end of the yoke has an elongate slot in which is carried a roller 186 for resting on either the lower or the upper step in accordance with the horizontal position of the head. A pair of shafts 185 extending downwardly from lower ends of the yoke are slidingly received within a guide 187 of the head 46, support the clapper switch holding platform 52 at their lower ends and are of a length to allow vertical movement of the clapper switch 36 with respect to the head. The arrangement is such that when the head is lowered and the roller rests on one of the steps, as the pattern 32 rotates on the clapper switch the head 46 is moved up and down in accordance with the configuration of the pattern to move the lens 28 toward and away from the roughing wheel 38 or the finishing wheel 40 to grind the lens periphery to a configuration corresponding to that of the pattern. Since downward movement of the head is limited by the height of the clapper switch and therefore by engagement of the roller 186 with one of the steps, the setting of the eye-size compound assembly 42 determines the overall peripheral dimensions to which the lens will be ground. The structure requires only a single clapper switch, instead of a pair of clapper switches having different heights as is conventional, it being understood that during rough grinding the head is moved to the right as viewed in FIGS. 1 and 5, so that the roller rests on the upper step 180, while during bevel edging movement of the head to the left positions the roller to rest on the lower step 178. Also, the particular structure orients the roller, pattern and lens in vertical alignment, which minimizes bending moments of force on the lens chuck and head to ensure that movement of the pattern is very accurately followed by the lens.

During rough grinding of a lens periphery, the head 46 is locked against pivotal movement on the float 76, while during finishing it is free to pivot. To selectively lock and unlock the head against pivotal movement, as shown in FIGS. 3 and 4 a circular plate 188 of ferromagnetic material is fastened to the lower end of the shaft 78 which mounts the head for pivoting. A circular electromagnetic coil 190 mounts on the bottom **76*b*** of the float, and has a pole face immediately above and adjacent to the plate. When the electromagnet is deenergized, the plate and shaft are free to rotate and the head is free to pivot. However, when the electromagnet is energized, the plate is attracted and locked to the electromagnet and acts as a brake to prevent rotation of the shaft and pivoting of the head.

Switches 192 on the panel 44 control such operations of the bevel edging machine as power on, start, reset and actuation of the chucking cylinder 26, as well as a function which moves the peripheries of successive lenses sequentially against different portions of the grinding surface of the roughing wheel 38, so that the surface wears uniformly as described in Vulich et al U.S. Pat. No. 4,176,498, issued Dec. 4, 1979, and assigned to the assignee of the present invention, the teachings of which are incorporated herein by reference. The switches also enable selection of a roughing only cycle, a finishing only cycle or both roughing and finishing cycles, as well as control over the left/right movement or horizontal drive motor 116, in accordance with the base curve of a lens, to ensure that the lens is positioned with respect to the finishing wheel so that a bevel is formed toward its front face. For example, the switches may provide for selective placement of a lens with respect to the finishing wheel in accordance with the lens having a base curve of 0-4, 4-8, 8-12 or in excess of 12.

Figure 7:
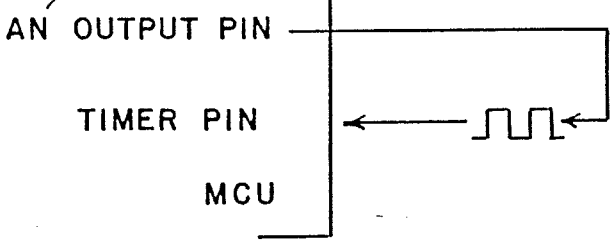

A control module and microcomputer unit (MCU) 19 is at the heart of the circuitry for controlling the bevel edger, and receives inputs from and provides LED indicator outputs to the switches 192 on the control panel. The MCU also receives inputs from index switches, such as the left/right limit switches 124 and 126 and the up/down limit switches 150 and 152, as well as from the clapper switch 36, the swinger of which normally connects to a normally closed (N.C.) contact when the clapper is not engaged by the pattern 32, but connects with a normally open (N.O.) contact when the clapper is engaged and depressed by the pattern. Outputs from the MCU control, through appropriate relays or driver circuits (not shown), various machine functions, such as energization and deenergization of the grinding wheel drive motor 70, the horizontal index motor 116, the vertical index motor 144, the lens drive motor 56 and a pump (not shown) for supplying coolant to the grinding wheels and lens during grinding. The MCU also controls energization and deenergization of the electromagnetic head brake coil 190 to lock and unlock the head 46 against and for pivotal movement, operation of the pneumatic chuck cylinder 26 to clamp and release lenses and sounding of a beeper to audibly indicate the setting and actuation of front panel switches. As shown in FIG. 7, included in the MCU is a timer 196 having an output pin for providing clock pulses to a timer input pin. The MCU may be an 8-bit EPROM microcomputer unit, which may readily be programmed by one skilled in the art to control the bevel edging machine operations and functions as hereinafter described.

The machine may be operated to selectively perform any one of a roughing only cycle, a bevel edging only cycle or both roughing and bevel edging cycles. However, only the latter operation of the machine in performing the combination of both roughing and beveling cycles will be specifically considered, since a description of the combined cycles includes a description of the individual ones. To begin, an operator turns on power to the machine and operates the chucking switch to energize the pneumatic cylinder 26 and bring the chuck arms 22 and 24 together to grip a blocked lens. If successive lenses are to be sequentially moved against different surface portions of the roughing wheel 38 so that the wheel wears evenly, the switch controlling that function is also energized so that the machine will then perform a sequential lens placement operation in a manner similar to that taught in said Vulich et al U.S. Pat. No. 4,176,498, except that in the present situation lens placement is controlled by means of software instead of an R-C circuit. The appropriate switch corresponding to the lens having a base curve of 0-4, 4-8, 8-12 or in excess of 12 is also actuated, so that during the bevel edging cycle the lens will be positioned with respect to the V-shaped groove 72 in the finishing wheel 40 so as to form a bevel on the lens periphery toward the front face of the lens.

At the end of a selected cycle or cycles of operation, the left/right motor 116 is energized to move the head 46 to its leftmost position whereat a head straightening bar 198 engages the left side of the rectangular rearward end 74 of the head and pivots the head to a position perpendicular to the float 76. The up/down movement motor 144 is also energized to elevate the carriage 88 and the head to a point at which the top of the guide 187 engages the lower end of the yoke 182 and elevates the yoke roller 186 above the support bar 176 and stepped plate, and the top 94 of the carriage engages the top wall 130 of the movable frame 128 and elevates the movable frame with respect to the fixed frame 54. This is the condition of the machine at the time a selected cycle or cycles of operation are commenced, and with the movable frame elevated above the fixed frame, the foot 166 of the eye-size compound assembly 42 is above the platform 168, which relieves pressure on the eye-size compound assembly, so that with an appropriate pattern 32 mounted on the pattern holder 34, the eye-size compound assembly may be adjusted to a setting determining the overall dimensions to which the periphery of the lens will be ground.

The rough grinding and bevel edging cycles are begun by actuating the start switch, whereupon the MCU 194 assumes control and energizes the electromagnetic brake 190 to lock the head 46 against pivotal movement. The left/right movement motor 116 is then energized to move the float and head horizontally until the lens periphery is above a selected surface portion of the roughing wheel 38. The portion of the grinding surface above which the lens is positioned is determined by the time for which the motor is energized to translate the float and head horizontally from their rest position, and is controlled by the time required to decrement to zero a register or counter having a predetermined stored count. To that end, the timer 196 of the MCU may be used in a pulse count mode, and the MCU program includes a table of count values corresponding to points on the roughing wheel surface against which a lens periphery is to be engaged. Depending upon the roughing wheel surface portion to be used for a particular lens grinding operation, a count corresponding to that portion is loaded into the register and decremented by the clock signal at the output pin from the timer 196 as applied to an input timer pin, until such time as the register is decremented to zero. During decrementing the MCU energizes the motor 116, so that the time of energization, and therefore the distance the head and lens are translated horizontally, is determined by the count loaded into the register and the period of the clock. The clock may have a 1 ms period, although for longer decrementing intervals a pre-scaler may be used so that, for example, the register is decremented by one count every 64 ms.

When the lens is above the roughing wheel the yoke roller 186 is above the upper step 180 of the stepped plate, and the up/down movement motor 144 is then energized to lower the carriage 88 and head 46 to bring the lens periphery into contact with the grinding surface of the roughing wheel 38 and the yoke roller onto the upper step. Because the lens has a relatively large initial diameter, when it first engages the roughing wheel surface it holds the head in an elevated position with the pattern 32 above and out of engagement with the clapper switch 36, the height of which with respect to the fixed frame 54, and therefore with respect to the grinding wheels, is determined by the height of the upper step.

If operated in a conventional manner, the lens drive motor 56 would not be energized to rotate the lens until the lens periphery was ground away by an amount sufficient to lower the head 46 to a point whereat the pattern 32 moves against and closes the clapper switch 36. However, when grinding a large diameter lens, especially a thick one, it takes a relatively long time to reach that point. Accordingly, to shorten the grinding time and prolong the life of the roughing wheel 38 and wheel drive motor 70, at this time the MCU is looking at the down limit switch 152, as well as at the clapper switch, which is in its N.C. state when the pattern is not engaging it. If within a selected time interval after actuation of the down limit switch, for example 3 seconds, the MCU does not detect closure of the clapper switch, the MCU momentarily energizes the lens drive motor for a predetermined time, such as for 200 milliseconds to rotate the lens through about 9°. This "pulsing" of the lens drive motor then continues at the end of successive selected time intervals, until the MCU detects closure of the clapper switch to its N.O. state by the pattern.

Upon the MCU detecting the first closure of the clapper switch 36 to its N.O. state, it begins to control the lens drive motor 56 in accordance with the state of the switch, such that the lens drive motor is energized in response to the N.O. state, and deenergized in response to the N.C. state. Therefore, upon the lens periphery being ground away by an amount sufficient to lower the head to a point where the pattern moves against the clapper switch and the switch changes to its N.O. state, the MCU energizes the lens drive motor for as long as the switch is in that state. During the first complete revolution of the lens, as unground peripheral portions of the lens are rotated against the grinding wheel, the pattern is alternately raised above and lowered against the clapper switch, intermittently changing the state of the switch and causing intermittent energization of the lens drive motor to maintain unground peripheral portions of the lens in contact with the roughing wheel surface for a time sufficient to be properly ground away.

In conventional bevel edging machines, the usual procedure is to limit the lens to two complete rotations during rough grinding, after which it is assumed that the grinding operation is complete. However, it often happens that two revolutions are not sufficient to fully complete the rough grinding cycle, particularly with thick lenses of a large minus power. To overcome this disadvantage, in accordance with the invention there is no fixed number of revolutions through which a lens is rotated during a grinding cycle, but instead it is rotated for as long as necessary to fully complete a grinding cycle. To accomplish the result, the MCU 194 includes a register in which is stored a predetermined count that is decremented by the clock pulse. The value of the count is such that it requires a selected period of time to be decremented to zero, for example eight seconds, which is at least equal to the time required for the lens to be rotated through at least one complete revolution, and the MCU is programmed so that decrementing occurs whenever and while the clapper switch is in its N.O. state, but the register is reset to its initial count whenever the clapper switch leaves that state. Rough grinding continues until the register is decremented to zero, at which point the clapper switch has continuously remained in its N.O. state for the selected time, thereby ensuring that the rough grinding cycle is fully completed.

Figure 8:
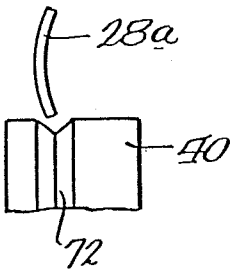
FIGS. 8 and 9 illustrate the manner in which ophthalmic lenses of different base curves are positioned with respect to a finishing wheel of the machine.
Figure 9:
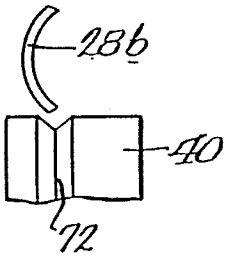

When the MCU 194 determines that the roughing cycle is over, the up/down movement motor 144 is energized to elevate the carriage 88 and head 46 to raise the lens 28 away from the roughing wheel 38 and the yoke roller 186 above the upper step 180. The left/right movement motor 116 is then energized for a selected period of time to translate the head horizontally to move the yoke roller over the lower step 178 and the lens periphery to a selected position over the V-shaped groove 72 in the finishing wheel 40, which position is such that a bevel formed on the lens periphery will be toward the front face of the lens. The lens is supported by the chuck arms 22 and 24 on opposite sides of its center point, and as seen from a comparison of FIG. 8, which shows a lens 28*a* of a relatively small base curve, and FIG. 9, which shows a lens 28*b* of a relatively large base curve, lenses of different base curves require different amounts of horizontal translation for their peripheries to be properly positioned with respect to the groove in the finishing wheel. Therefore, depending upon the particular base curve switch actuated at the beginning of the edging cycle, a selected count is advanced into a register and is decremented to zero at a predetermined rate by the clock pulse, with the left/right motor 116 being energized by the MCU during decrementing and the count having a value to provide the selected period of energization of the motor and horizontal translation of the head. The up/down movement motor is then energized to lower the carriage and head to bring the lens periphery into contact with the finishing wheel groove and the yoke roller onto the lower step.

Up to this point the electromagnetic head brake coil 190 has been energized to lock the head 46 against pivotal movement on the float 76, and the MCU 194 continues to energize the brake until the pattern first engages the clapper switch 36 and changes it to its N.O. state at the beginning of the bevel edging cycle, whereupon the MCU releases the brake and frees the head to pivot during bevel edging, which pivoting movement, in combination with the angulated bevel edging wheel, enhances accurate placement of the bevel toward the lens front face. The bevel edging cycle then proceeds in a manner similar to the portion of the roughing cycle controlled by the clapper switch, with the lens drive motor 56 being energized and deenergized in accordance with the pattern 32 changing the state of the clapper switch, until such time as the clapper switch continuously remains in its N.O. state for the selected time, which ensures that the bevel edging cycle is fully completed.

At the end of the bevel edging cycle the up/down movement motor 144 is energized to elevate the carriage 88 and head 46 to move the lens away from the beveling wheel 40 and to raise the yoke roller 186. Raising the head also moves the pattern 32 off of the clapper switch 36, and as soon as the MCU 194 senses that the clapper switch has changed to its N.C. state it energizes the electromagnetic brake 190 to lock the head in position and to maintain it in its then pivotal orientation. Consequently, should it be determined that further bevel edging is required, the head is already properly pivotally oriented to accurately place the previously formed bevel on the lens into the finishing wheel groove, which eliminates the need for manual manipulation by an operator and the potential for accidentally destroying the bevel.

If further bevel edging of the lens is not required, the electromagnetic brake 190 is released and the left/right horizontal movement motor 16 is energized to return the machine to its initial condition, whereupon the operator may insert the next lens to be edged into the machine and select the appropriate parameters for the edging cycle. Although only the combination of rough grinding and bevel edging cycles has been described, it is understood that either cycle may be selected by itself, in which case the machine would perform the selected cycle in the same manner as it is performed when the machine operates through both cycles.

While one embodiment of the invention has been described in detail, various modifications and other embodiments thereof may be devised by one skilled in the art without departing from the spirit and scope of the invention, as defined in the appended claims

What is claimed is:

1. Apparatus for grinding bevels on the peripheries of ophthalmic lenses, comprising a rotatable grinding wheel having a grinding surface and a groove in and circumferentially around said surface; a workholder for supporting and rotating a lens about an axis; motor means for translating said workholder from a reference position to an operative position whereat the periphery of the lens is in position to be ground; means for moving said workholder and grinding wheel together, after said workholder is in said operative position, to move the rotating lens periphery into said groove to grind a bevel on the periphery; and circuit means for controlling operation of said motor means in accordance with the base curve of the lens being ground, so that the distance said workholder is translated from said reference to said operative position is in accordance with the base curve to position the lens periphery with respect to said groove so that when said workholder and grinding wheel are moved together the bevel is ground on the periphery toward the front face of the lens.

2. Apparatus as in claim 1, wherein said motor means translates said workholder at a constant speed and said circuit means operates said motor means to translate said workholder from said reference position for a time in accordance with the base curve of the lens.

3. Apparatus as in claim 2, wherein said circuit means includes a count storing register, means for storing in said register a selected count having a value in accordance with the base curve of the lens, means for decrementing the selected count stored in said register at a selected rate to at least a predetermined value, and means for operating said motor means to translate said workholder from said reference position while said register is being decremented from said selected count to at least said predetermined count.

4. Apparatus as in claim 3, wherein said predetermined count is zero.

5. Apparatus for grinding the peripheries of ophthalmic lenses, comprising a rotatable roughing wheel having a grinding surface; a rotatable beveling wheel having a grinding surface and a groove in and circumferentially around its surface; means for supporting and rotating said roughing and beveling wheels; a workholder for supporting and rotating a lens; motor means for moving said workholder and thereby the lens; and means for controlling operation of said motor means to move the lens toward said roughing wheel to engage the periphery of the rotating lens with said roughing wheel surface to rough grind the periphery, to then move the lens away from said roughing wheel to a reference position, to then translate the lens from said reference position to an operative position, and to then move the lens from said operative position toward said beveling wheel to move the periphery of the rotating lens into said groove to grind a bevel on the periphery, said means for controlling operation of said motor means operating said motor means to translate the lens through a distance selected in accordance with the base curve of the lens, from said reference to said operative position, so that at said operative position the lens is oriented with respect to said groove such that when the lens periphery is moved into said groove the bevel is ground on the periphery toward the front face of the lens.

6. Apparatus as in claim 5, wherein said means for controlling comprises circuit means.

7. A method of grinding the peripheries of ophthalmic lenses, comprising the steps of rotating a grinding wheel about an axis, the grinding wheel having a grinding surface and a groove in and circumferentially around the surface; rotating a lens about an axis; translating the lens a distance, selected in accordance with the base curve of the lens, from a reference position to an operative position; and moving the periphery of the rotating lens from the operative position into the grinding wheel groove to grind a bevel on the lens periphery, wherein the selected distance is such that at the operative position the lens is oriented with respect to the grinding wheel groove so that the bevel is ground on the lens periphery toward the front face of the lens.

8. A method as in claim 7, wherein said translating step comprises translating the lens from the reference position to the operative position at a constant rate for a time selected in accordance with the base curve of the lens.

9. A method as in claim 8, wherein said translating step comprises entering into a register a count having a value selected in accordance with the base curve of the lens, changing the count in the register at a predetermined rate while the lens is translated from the reference to the operative position, and terminating translation of the lens upon the register count being changed to at least a selected value.

10. A method as in claim 9, wherein said step of changing the register count comprises decrementing the count at the predetermined rate and the selected value is zero.

11. A method of grinding the peripheries of ophthalmic lenses, comprising the steps of rotating a roughing wheel having a grinding surface; rotating a beveling wheel having a grinding surface and a groove in and circumferentially around its surface; rotating a lens about its axis; moving the rotating lens toward the roughing wheel to engage the lens periphery with the roughing wheel grinding surface to rough grind the periphery; moving the lens away from the roughing wheel to a reference position; translating the lens through a distance selected in accordance with the base curve of the lens, from the reference position to an operative position; and moving the lens from the operative position toward the beveling wheel to move the periphery of the rotating lens into the beveling wheel groove to grind a bevel on the periphery, wherein the distance selected in accordance with the base curve of the lens is such that at the operative position the lens is oriented with respect to the beveling wheel groove so that upon the lens periphery being moved into the groove the bevel is ground on the periphery toward the front face of the lens.

* * * * *